US005925314A

United States Patent [19]

Nishiguchi et al.

[11] Patent Number: 5,925,314

[45] **Date of Patent: *Jul. 20, 1999**

[54] HIGH DUCTILITY ALUMINUM ALLOY AND METHOD FOR MANUFACTURING THE HIGH DUCTILITY ALUMINUM ALLOY

[75] Inventors: Katsuya Nishiguchi; Yukio Yamamoto; Yukihiro Sugimoto, all of Hiroshima, Japan

[73] Assignee: Mazda Motor Corporation, Hiroshima, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/829,693

[22] Filed: Mar. 31, 1997

[30] Foreign Application Priority Data

Mar. 29, 1996 [JP] Japan ..... 8-103819
Feb. 24, 1997 [JP] Japan ..... 9-056821

[51] Int. Cl.[6] ..... C22C 21/00

[52] U.S. Cl. ..... 420/528; 148/688; 148/689; 148/695; 148/696; 148/415

[58] Field of Search ..... 420/528; 148/688, 148/689, 695, 696, 415

[56] References Cited

U.S. PATENT DOCUMENTS 4,415,374 11/1983 Young et al. ..... 148/2
4,711,762 12/1987 Vernan et al. ..... 420/532

FOREIGN PATENT DOCUMENTS 62-149839 7/1987 Japan .
6-330202 11/1994 Japan .
7-252616 10/1995 Japan .

*Primary Examiner*—Patrick Ryan
*Assistant Examiner*—M. Alexandra Elve
*Attorney, Agent, or Firm*—Sixbey, Friedman, Leedom & Ferguson; Donald R. Studebaker

[57] ABSTRACT

It is an object of the invention to provide high-ductility alloy which is improved both in casting characteristics and elongation without lowering strength by selecting a good combination of ingredients and a proportion thereof. It is another object of the invention to provide a casting which has an good elongation without being heat-treated. It is a further object of the invention to provide a method of manufacturing integral parts having some portions with specific construction which make it impossible for a set of molding dies to be separated after finishing casting by means of in-one-piece molding. Those objects can be accomplished bay providing an high ductility aluminum alloy which contains manganese ingredient, iron ingredient, magnesium ingredient and slice of unavoidable impurity, wherein a content of the iron usually regarded as impurity is set within specified limits, magnesium content is relatively less and manganese content is relatively more than that in a conventional aluminum alloy. More specifically the high ductility Al alloy contains 1.0–2.0% by weight manganese, 0.4–1.5 & % by weight iron, 0.91–0.5% bit weight magnesium and the balance of aluminum and impurities.

16 Claims, 18 Drawing Sheets

FIG. 32

| ALLOY | ELEMENT | | | | | TENSIL STRNGTH (MPa) | ELONGATION (%) | 0.2% DURABILITY (MPa) | CASTING EVALUATION |
|---|---|---|---|---|---|---|---|---|---|
| | Mn | Fe | Mg | Si | Al | | | | |
| EX. I | 1.33 | 0.45 | 0.30 | 0.04 | REMAINING | 162 | 94 | 18 | a |
| EX II | 1.93 | 0.16 | 0.97 | 0.04 | REMAINING | 189 | 103 | 11 | b |
| EX III | 1.44 | 0.19 | 0.37 | 0.05 | REMAINING | 160 | 91 | 20 | c |
| EX IV | 0.94 | 0.23 | 0.48 | 0.05 | REMAINING | 159 | 87 | 22 | b |
| EX V | 1.93 | 0.15 | 0.43 | 0.04 | REMAINING | 173 | 94 | 16 | c |
| EX VI | 1.76 | 0.80 | 0.87 | 0.06 | REMAINING | 160 | 106 | 4 | a |
| EX VII | 0.87 | 0.89 | 0.76 | 0.06 | REMAINING | 169 | 90 | 16 | a |
| EX VIII | 2.02 | 0.78 | 0.24 | 0.06 | REMAINING | 140 | | 9 | a |
| EX IX | 2.01 | 0.64 | 0.32 | 0.06 | REMAINING | 157 | | 8 | b |
| EX X | 1.02 | 0.15 | 0.89 | 0.06 | REMAINING | 165 | 90 | 22 | c |
| EX XI | 1.34 | 0.72 | 0.34 | 0.05 | REMAINING | 164 | 92 | 17 | a |
| EX XII | 1.41 | 1.17 | 0.31 | 0.05 | REMAINING | 152 | 87 | 9 | a |
| EX XIII | 1.91 | 0.78 | 0.01 | 0.06 | REMAINING | 123 | | 10 | a |
| EX XIV | 1.60 | 0.16 | 0.79 | 0.06 | REMAINING | 177 | 95 | 20 | b |
| ADC6 | 0.50 | 0.10 | 4.00 | 0.10 | REMAINING | 207 | 140 | 4 | d |
| ADC7 | — | 0.56 | — | 4.90 | REMAINING | 136 | 75 | 3 | d |

HIGH DUCTILITY ALUMINUM ALLOY AND METHOD FOR MANUFACTURING THE HIGH DUCTILITY ALUMINUM ALLOY

BACKGROUND OF THE INVENTION

1. Field of the Invention

This invention relates to a non-heat-treatment type aluminum alloy having high ductility for diecasting and a method of manufacturing parts made of the alloy.

2. Background of the Invention

High-pressure diecasting is used for manufacturing an aluminum casting in various industries because of its good characteristics of molding and lower manufacturing cost than other casting method. As aluminum alloys used for the high-pressure diecasting, ADC5 and ADC6 defined in H5302 of JIS (Japanese Industrial Standard), or ADC7 defined in the former JIS, the ADC7 were, however, removed from the former JIS at its second amendment on Nov. 1, 1976 because of its infrequent use, are known. Recently in the automobile industry, molding a plurality of parts in one piece out of an aluminum alloy has been studied and developed for the purpose of reducing cast and weight by use of the high-pressure diecasting. However the one-piece molding can not be applied when the designed integral part has some portions with specific construction which make it impossible for a set of molding dies to be separated after finishing molding. It could be one of ways to solve this problem that an initial construction to make it possible for the molding dies to be separated is given first and, after finishing the separation of molding dies, a plastic deformation is given to the portions by bending operation to give the molded part the predetermined shape. It is however difficult to realize the idea mentioned above because aluminum alloy for diecasting has generally such a poor ductility that the bending operation tends to give a product fractures or cracks and to have it broken. To solve such a problem, Japanese Unexamined Patent Publication No. 3-122242 and 6-330202 disclose aluminum alloys with improved strength, ductility and toughness which are yielded by changing the ingredients and the proportion of the ingredients of the alloys. Japanese Unexamined Patent Publications Nos. 62-149839 and 7-252616 suggest other aluminum alloys with increased strength and abrasion resistance which is realized by increasing silica ingredient.

The prior art aluminum alloy which has relatively rich magnesium ingredient has higher strength and, however, tends to produce defects such as shrinkage cavity inside the cast product, and to give more fractures on the surface of the product, in other words, to get the fractures characteristics, which means the degree of fractures appearance, worse. Thus relatively rich magnesium ingredient aluminum alloy generally has rather poor casting characteristics. Therefor, the elongation of the cast product out of the rich magnesium aluminum alloy get smaller than that of alloy itself. In fact, a cast product out of ADC6 and other alloys as samples of the magnesium rich alloy meeting the aforesaid JIS show a smaller elongation rates than that of the alloy itself. Also an alloy disclosed in the publication Nos. 3-122242 and 6-330202 include relatively rich magnesium ingredient like the allay defined in JIS, so a good elongation of the molded product is not expected. As the alloys disclosed in the publications 62-149839 and 7-252616 have silica ingredient as relatively rich as the alloy ADC7 defined in JIS, it has slightly better casting characteristics and the degree of elongation of the alloy itself however reduces and becomes lower than that of the alloys defined in JIS. Thus generally there is an inverse relationship between casting characteristics and elongation. Namely trying to improve casting characteristics of an alloy by changing ingredients or proportion thereof results in reducing the elongation of the alloy itself and, on the other hand, making an elongation of an alloy itself higher causes the casting characteristic to get worse, which as one whole brings a reduction in elongation of the cast product. As a result it has been difficult to get the alloy having good casting characteristics in addition to good elongation so that the cast product made of the alloy can be plasmically deformed by bending or the like. Meanwhile it is possible to improve the elongation of the molded product by heat-treating or to male it easy to deform the product plasmically by keeping it at a high temperature, but that method does not always give sufficient results and yet usually cause a cost increase.

SUMMARY OF THE INVENTION

It is an object of the invention to provide an high-strength alloy which is improved in the casting characteristics and the elongation by selecting an appropriate combination of ingredients and a proportion thereof.

It is another object of the invention to provide an molded product which has a high elongation without being heat-treated.

It is a further object of the invention to provide a method of manufacturing integral parts having some portions thereof with specific construction which makes it impossible for a set of molding dies to be separated after finishing molding by use of one-piece molding.

According to the invention, the foregoing objects are accomplished by providing an aluminum alloy which contains manganese ingredient, iron ingredient, magnesium ingredient and silica of impurity, wherein a content of the iron usually regarded as impurity is set within specified limits. A content of magnesium is relatively less and the one of manganese is relatively more than that in a conventional aluminum alloy.

The high ductility aluminum alloy contains 1.0–2.0 weight % of manganese, 0.4–1.5 weight % of Fe, 0.01–0.5 weight % of magnesium and the balance of aluminum and impurities. Namely, if the manganese content is less than 1.0% by weight, effect of strengthening the alloy by dissolving reduces, which leads to reducing tensile strength. On the other hand, if the manganese content is more than 2.0% by weight, the reaction of manganese with other elements tend to occur and form the compounds, which also result in the reduction of the tensile strength and insufficient improvement of the elongation, therefor manganese content should be in the range of 1.0–2.0% by weight. If iron content is less than 0.4% by weight, it often causes burning between the alloy and the mold, which leads to insufficient improvement of fractures characteristics. On the other hand, if the Fe content is more than 1.5% by weight, the reaction of iron with other elements tend to occur and form the compounds, which also result in the elongation less than that of conventional alloy, therefor iron content should be in the range of 0.4–1.5% by weight.

Further if magnesium content is less than 0.01% by weight, as in the case of manganese aforesaid, effect of increasing the tensile strength by dissolving reduces, if more than 0.5% by weight, which lowers the elongation. Thus manganese content should be from 0.01 to 0.5 by weight.

In the invention, manganese content and iron content have more limited ranges than those described above, that is, manganese content is from 1.2–1.6% by weight and iron content is from 0.4–0.7% by weight. This composition is selected because if iron is more than 0.7% by weight, which results in the insufficient improvement of the elongation and if less than 0.4% by weight, the fractures characteristics is not improved sufficiently. By using the more limited range of manganese, 1.2–1.6% by weight in addition to the more limited range of iron content, further improvement of the elongation without lowering the fracture characteristics and the strength are given.

The high ductility aluminum alloy contains 1.5–2.5% by weight manganese, 0.1–0.3% by weight iron, 0.7–1.2% by weight magnesium and the rest; aluminum and impurities. This is because magnesium content less than 0.7% by weight gives insufficient tensile strength, the one more than 1.2% by weight facilitates the oxidization of the molten aluminum alloy, which leads to lower quality products and decreases the fluidity which causes bad casting characteristics, further tends to form compounds, which causes the reduction of the elongation. The higher content of magnesium than that less than 0.5% in claim 1 and 2 gives lower elongation compared to the one in those claims. In addition to this, if Fe is more that 0.3% the elongation become worse. If less than 0.1%, which causes burning with the mold and get the fractures characteristics worse. Thus Fe should be between 0.1–0.3% by weight. As to manganese, less than 15% by weight manganese gives insufficient improvement of the strength and more than 2.5% reduces tensile strength and reduces the elongation to the one which is lower than that of the conventional aluminum alloy. Thus manganese should be between 1.5 and 2.5% by weight. This composition gives further improvement of strength without lowering elongation and casting characteristics.

The alloy has a more preferable range of manganese, 1.8–2.2% by weight to give higher strength with sufficient elongation.

The alloy may further include at least one of following three ingredients, 0.1–0.2% by weight titanium, 0.01–0.1% by weight boron and 0.01–0.2% by weight beryllium. Those titan, boron and beryllium are capable of making the grains in a casting finer, which leads to the improvement of the fracture characteristics. But if the amount of additions are less than 0.1% by weight with titanium, less than 0.01% by weight with boron and less than 0.01% by weight with beryllium, the effect by the additions is not enough to improve the fracture characteristics. When the amount is more than 0.2%, 0.1% and 0.2% respectively, large-size compounds are formed, which leads to lowering the elongation. Further titanium of this amount reduces the fluidity of the molten alloy. Thus those respective amounts previously set forth above should be chosen for improving the fracture characteristics without reducing the elongation of the alloys.

In the manufacturing method of high ductility Al alloy parts, first, a casting is made by high-pressure diecasting using high ductility aluminum alloy including 0.5–2.5% by weight manganese, 0.1–1.5% by weight iron and 0.01–1.2% by weight and then some specified portions of the casting are deformed plasmically approximately at room temperature. In the alloy, manganese less than 0.5% by weight reduce tensile strength too much and the one more than 2.5% decreases the strength and the elongation as set forth. The contents of iron and magnesium are chosen so as to secure the good casting characteristics and the elongation with having fair strength. These characteristics enable to obtain a casting with high elongation without heat treatment. Therefor plastic deformation can be applied to some specific portions to get the designed shapes approximately at room temperature without having fractures, cracks and breaks.

The alloy has a more preferable ranges of iron; 0.4–1.5% by weight and magnesium; 0.01–0.5 by weight to give effectively improved fracture characteristics without reducing g the elongation and the strength. This composition of the alloy gives further improved elongation to the casting, which makes the plastic deformation easier.

The alloy has a more preferable range of manganese; 1.0–2.0% by weight to give higher elongation with sufficient strength.

The alloy has a more preferable range of manganese; 1.2–1.6% by weight and iron; 0.4–0.7% by weight to have similar effects to the invention in claim 2.

The alloy has a more preferable ranges of iron; 0.1–0.3% by weight and magnesium; 0.7–1.2% by weight to give higher strength without lowering the elongation and casting characteristics. This composition improves the strength of the manufactured part while making plastic deformation easier.

The alloy has more preferable range of manganese; 1.5–2.5% by weight to give higher strength with sufficient elongation.

The alloy has a more preferable range of manganese; 1.8–2.2% by weight to have similar effects to the invention in claim 4.

The alloy may further include at least one of the following three ingredients; 0.1–0.2% by weight titanium; 0.01–0.1% by weight boron and 0.01–0.2% by weight beryllium.

The plastic deformation is given by bending where the inner radius of bent portion is longer than the thickness of the portion to be bent. The plastic deformation is given by drawing or punch stretching of stamping, both die-shoulder radius and punch shoulder radius of the stamping die is more than 5 times longer than the thickness of the portion to be drawn or stretched. By these arrangements a break or a crack of a casting produced at the position corresponding to the shoulder of the die or the punch can be avoided.

The plastic deformation is given to the portion of which structure or shape is difficult being made directly by high pressure diecasting. By this invention it becomes possible to produce the part which has such portions above in on piece, namely, an initial construction to make it possible for the molding dies to be separated are given first and after finishing the separation, a plastic deformation is given to the portions by ending operation to give the molded part the predetermined shape. This invention also make it possible to reduce the costs and the weights of such parts.

BRIEF DESCRIPTION OF DRAWINGS

FIG. 32 is a Table showing the experimental results of the alloy.

DETAILED DESCRIPTION OF THE INVENTION

Embodiment I

Figure 1:
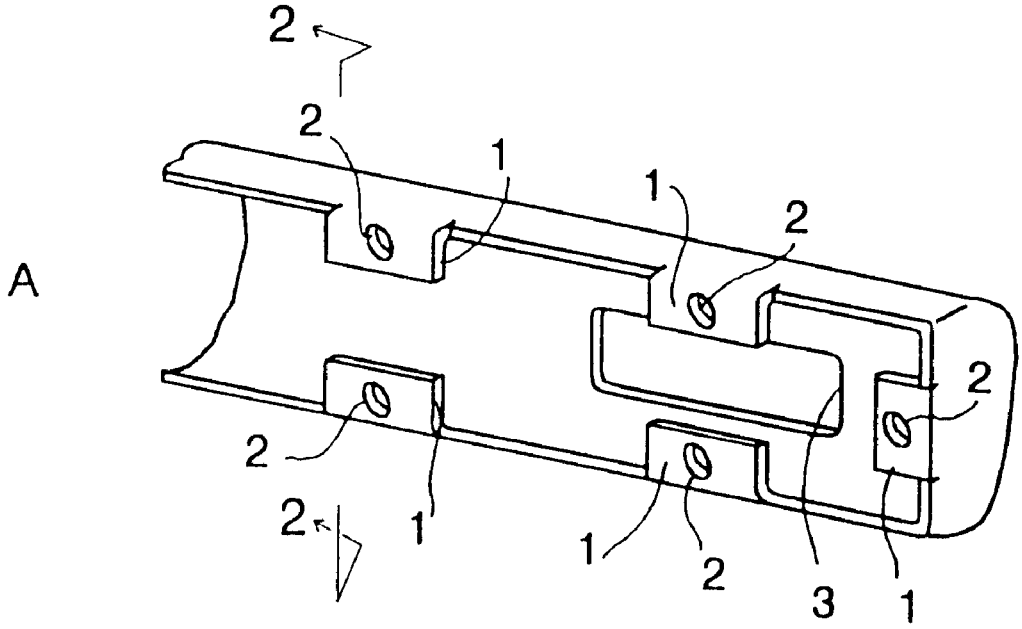
FIG. 1 is a fragmentary perspective view showing the rear side of instrument panel for automobile according to an embodiment of the invention.
Figure 2:
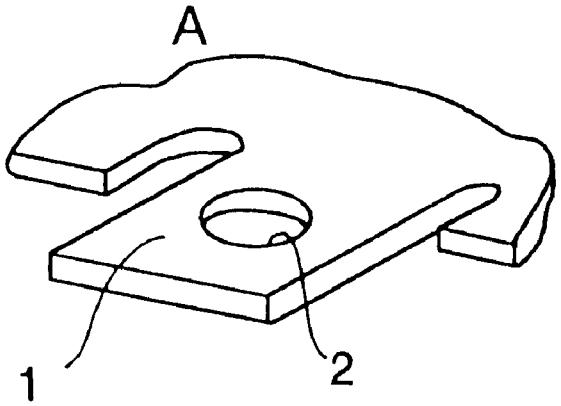
FIG. 2 is a magnified perspective view showing a rectangular mounting portion of the instrument panel made by casting which is not yet bent.
Figure 3:
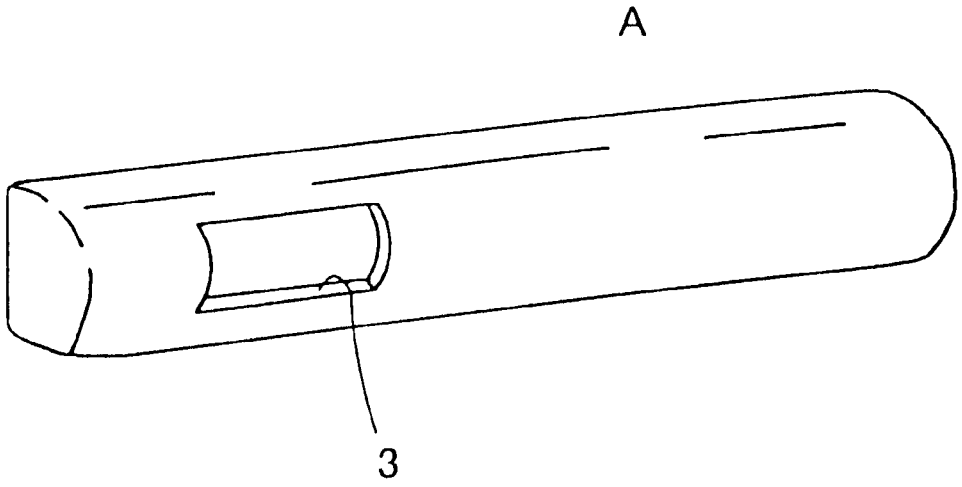
FIG. 3 is a perspective view of a front side of the instrument panel.

FIGS. 1 to 3 are fragmentary perspective views showing instrument panel A for automobile. In FIG. 1, panel A has a box-like shape with an opening on the rear side of which on the periphery are rectangular mounting portions 1 projected from the main part of the panel for securing it to the front part of the cabin. Each mounting portion has a pierced hole 2 in the middle and is bent toward the center of the opening approximately at right angles to the main part of the panel. Inner radius of the bent portion is longer than the thickness thereof. FIG. 2 shows magnified rectangular mounting portion made by casting which is not yet bent. An opening shown in FIG. 3 is for glove box.

The panel A comprises high ductility aluminum alloy with more than 10% elongation. The aluminum alloy contains 0.5–2.5% by weight manganese, 0.1–1.5% by weight iron, 0.01–½% by weight magnesium and the rest, aluminum and impurities. Namely, if the manganese content is less than 0.5% by weight, the effect of strengthening the alloy by dissolving reduces, which leads to reduced tensile strength. On the other hand, if the manganese content is more than 2.5% by weight, the reaction of manganese with other elements tends to occur and forms the compounds, which also results in a reduction in tensile strength and insufficient improvement of the elongation. Therefor manganese content should be in the range of 0.5–2.5% by weight. If magnesium content is less than 0.01% by weight, the effect of strengthening the alloy by dissolving reduces, which leads to reducing tensile strength as in the case of manganese, magnesium content more than 1.2% by weight facilitates the oxidization of molten aluminum alloy, then the oxides migrate into it which leads to lower quality products, decreases the fluidity which causes unfavorable casting characteristics, and further tends to form compounds, which causes the reduction in elongation too much. Thus, Mg should be between 0.01 and 1.2% by weight.

If magnesium content is less than 0.01% by weight, the effect of strengthening the alloy by dissolving reduces, which leads to reducing tensile strength as in the case of manganese, magnesium content more than 1.2% by weight facilitates the oxidation of molten aluminum alloy. Consequently, the oxides migrate into it which leads to lower quality products, decreases the fluidity which causes bad casting characteristics, and further tends to form compounds, which causes the reduction of the elongation too much. Thus Mg should be between 0.01 and 1.2 by weight.

It is possible to take another combination of ingredients such as 0.401.5% by weight iron, 0.01–0.5% by weight magnesium and same amount of manganese as the above. If iron content is less than 0.4, burning may occur which leads to insufficient fracture characteristics. Iron more than 1.5% by weight causes the elongation less than that of conventional alloy. Thus iron content should be between 0.4 and 1.5% by weight, although it gives the elongation less than that in the case of iron content less than 0.4. If magnesium is more than 0.5%, which causes further reduction of the elongation in addition to the reduction brought by the iron content above, magnesium less than 0.01 reduces the effect of strengthening. Thus magnesium should be in the range of 0.01–0.5.

It is also possible to take still a further combination of ingredients such as 0.1–0.3% by weight iron, 0.7–1.2% by weight magnesium and manganese same as the above. Magnesium less than 0.7% by weight makes it difficult to keep sufficiently high strength and the one more than 1.2 lowers molding characteristics and reduces the elongation badly. Thus magnesium content should be between 0.7–1.2% by weight although it gives the elongation less than that in the case of magnesium content less than 0.7% by weight. If iron is more than 0.3% by weight, which causes further reduction of the elongation in addition to the reduction brought by the magnesium content above. Iron less than 0.1% by weight tends to cause burning. Thus iron should be between 0.1 and 0.3.

For manufacturing the panel A, a casting is made by high pressure diecasting first. As discussed previously, however, the diecasting can not be applied when the designed integral part has some portions, like a rectangular mounting portion 1, with specific construction which makes it impossible for a set of molding dies one of which is for the rear part of the panel A and the other for the front to be separated (pulled apart each other) after finishing molding. For this reason, as shown in FIG. 2 an initial construction in which the rectangular mounting portions 1 of the panel A are not bent to make it possible for the molding dies to be separated is given first.

Figure 4:
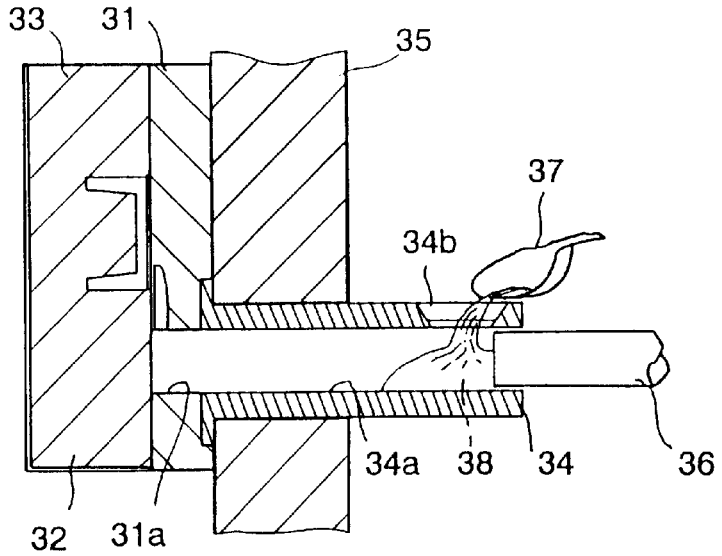
FIG. 4 is a cross-sectional view of deceased machine.

FIG. 4 shows a diecasting machine. Panel A is molded in the space 33 between a fixed mold 31 and a movable mold 32. The fixed mold is secured to a die plate 35 with an injection sleeve 34, and has a connecting hall 31*a* to connect the space 33 to a pierced ball 34*a* of the injection sleeve 34. A plunger 36 is fitted in the pierced hall 34 at one end of the injection sleeve 34 over which there is a pouring hall 34*b* to pour molten alloy into the space 33 to mold the panel A. The molded panel A still has straight rectangular mounting portions and then, those are deformed plasmically by bending to complete the panel A. Bending is performed at approximately room temperature and a inner radius for bending should be longer than the thickness of the portion to be bent for avoiding fractures, cracks or breaks.

Figure 5:
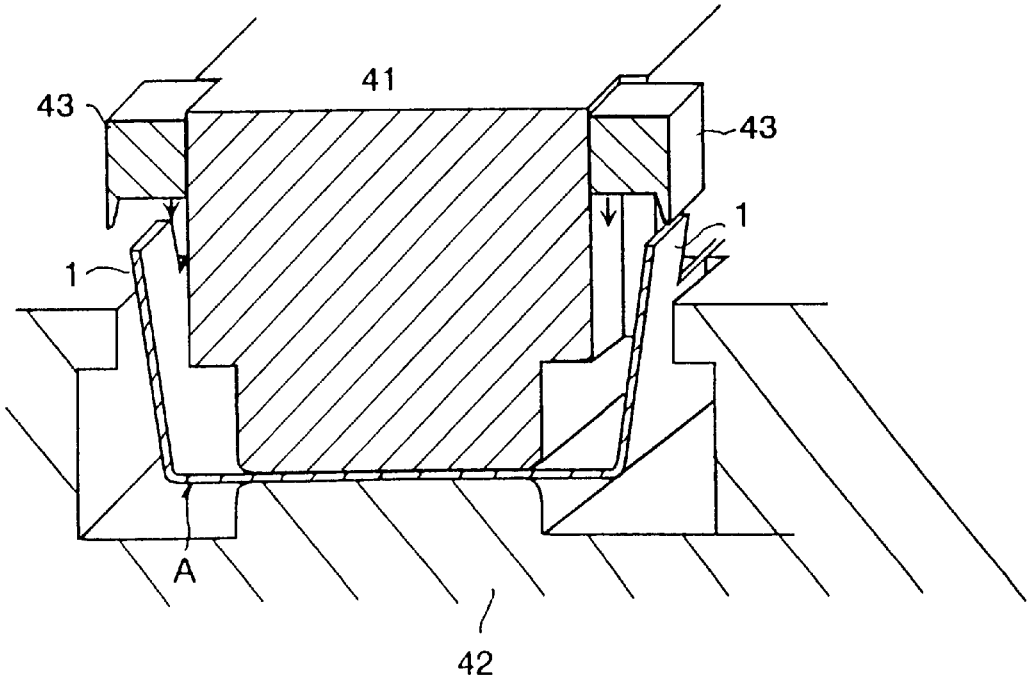
FIG. 5 is a perspective cross-sectional view taken on line V—V in FIG. 1, showing that rectangular mounting portions of the instrument panel are being bent by bending dies.

FIG. 5 shows bending die which comprises upper holder 41 and lower holder 42 used for camping the front part of the panel A, punches 43 mounted on the upper holder 41 which can slide up and down. Each punch is located in the position corresponding to each rectangular mounting portion 1 to bend it inward approximately at a right angle by sliding down.

Figure 6:
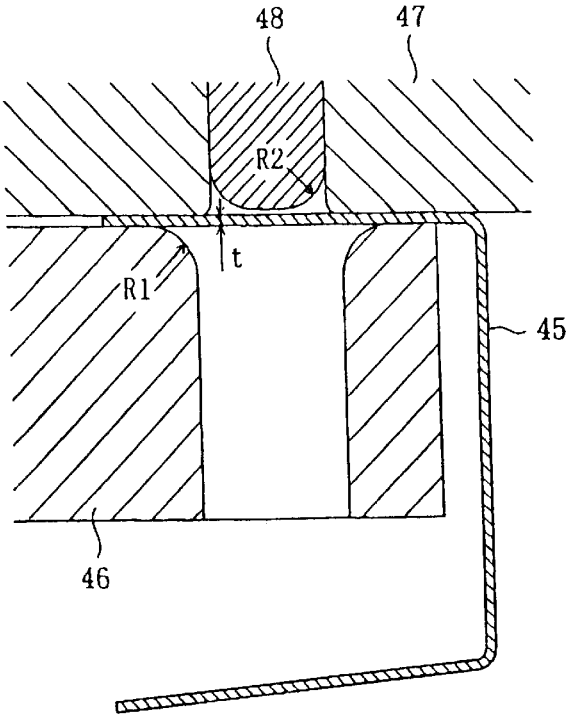
FIG. 6 is a cross-sectional view of stamping dies.
Figure 7:
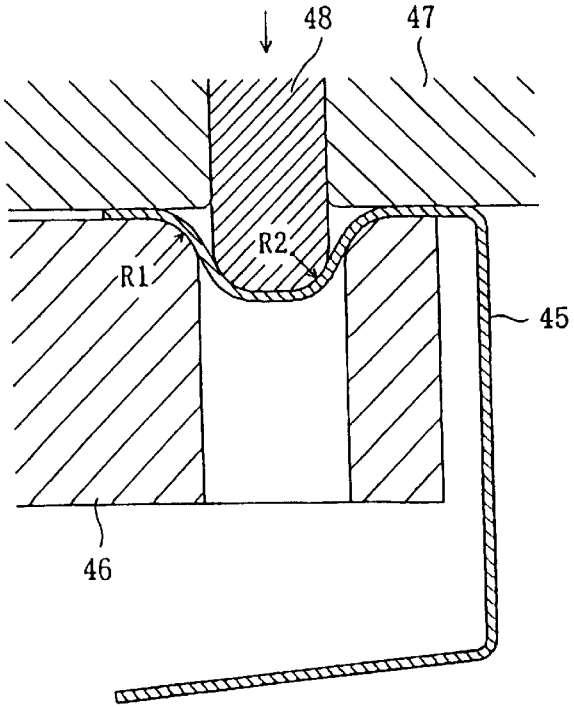
FIG. 7 is a cross-sectional view, corresponding to FIG. 6, showing a casting being drawn by the stamping dies.

In the application of drawing or punch stretching, as shown in FIGS. 6 and 7, a portion of a casting 45 to be bent is clamped between a die 46 and holder 47 and then punched to be formed into a predetermined shape. For this purpose, both die-shoulder radius R1 and punch shoulder radius R2 should be more than 5 times longer than the thickness of the portion to be drawn or stretched. These conditions are for avoiding fractures, cracks or breaks.

In this embodiment I, it is found that the part having some portions which make it difficult to apply diecasting directly because of its structure or shape can be made by using the combination of high ductility aluminum alloy of this invention with a bending process of this invention but without costly beat treatment and any defects like fractures, cracks or breaks in the portions, which reduces costs and weights of the part. Furthermore as the instrument panel is made of a high ductility aluminum alloy, it does not break but extends upon an occurrence of a vehicle collision. That is to say the instrument panel can absorb impact energy resulting from a collision, which serves to increase safety of the passenger.

It is possible to take another combination of ingredients such as 0,4–1.5% by weight iron, 0.01–0.5% by weight magnesium and same amount of manganese as the above. This combination further improves the fracture characteristics without lowering the elongation and the strength of the alloy. As a result the elongation of the casting is further increased, which makes it easier to deform the casting plastically.

It is also possible to take still a further combination of ingredients such as 0.1–0.3% by weight iron, 0.7–1.2% by weight magnesium and manganese same as the above. This combination increases the strength of the alloy which leads to the molding characteristics.

FIGS. 26 to 30 indicate the relation between manganese content and tensile strength or elongation of aluminum alloy, the relation between iron content and elongation.

Figure 31:
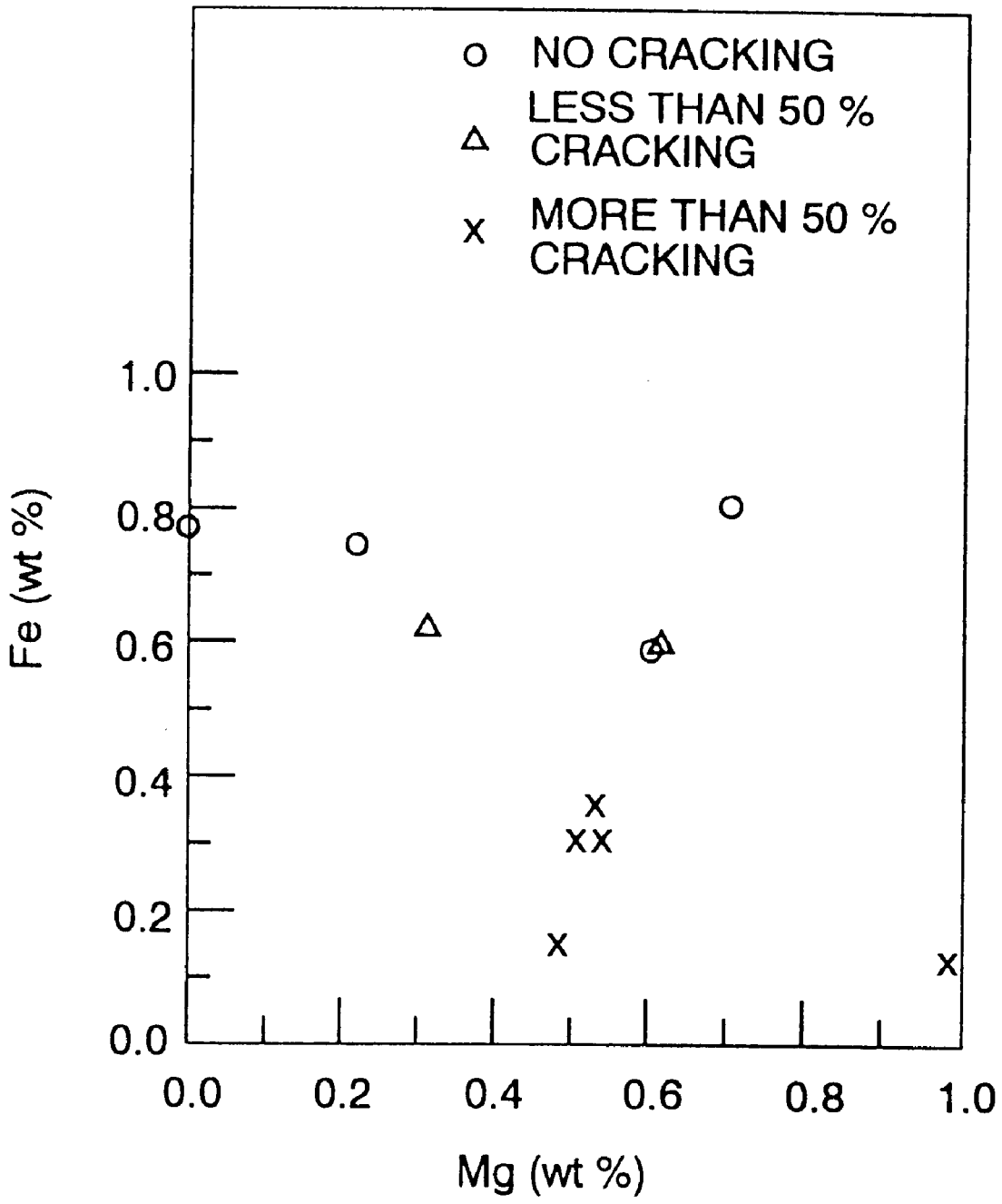
FIG. 31 is a graph showing a relation between contents of magnesium and iron, and rate of the appearance of the fractures.

FIG. 31 shows the relation between magnesium content, iron content and rate of the appearance of the fractures on the casting. According to these figures it can be said that the elongation decreases as the content increases with any ingredients, tensile strength reaches maximum at 2.0% by weight of manganese and increases with an increase in the magnesium content in a linear fashion. The fractures characteristics are improved more as the content in a linear fashion. The fractures characteristics are is improved more as the content of iron increases. Thus the suitable and useful range of content of manganese iron and magnesium are determined.

Embodiment II

Figure 8:
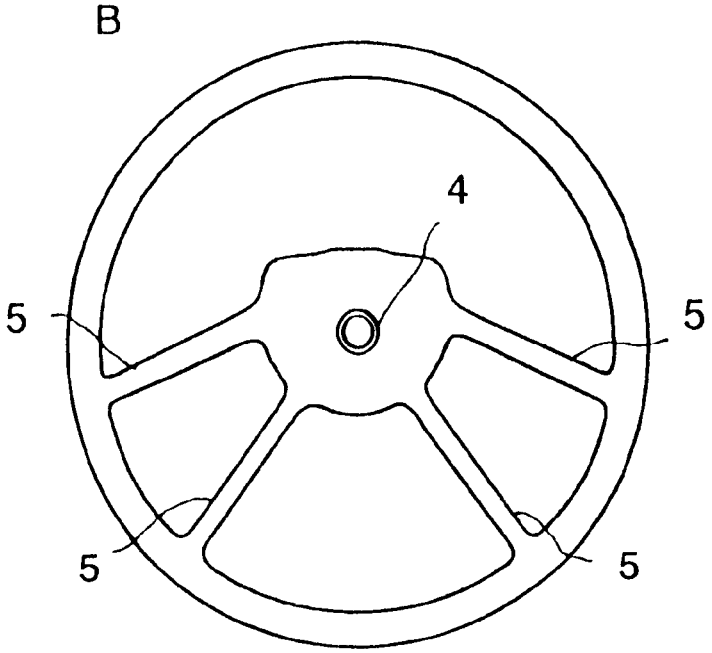
FIG. 8 is a plan skeleton view of a steering wheel according to another embodiment of the invention.

FIG. 8 shows a steering wheel skeleton B with steering shaft mounting hall 4 and spokes 5 to which the invention is applied. The steering wheel skeleton is integrally made from an Al alloy as in the embodiment I. Unlike in the embodiment I it does not have a portion which make it impossible to separate the molds after finishing diecasting, so it is made directly by high pressure diecasting. The aluminum alloy contains 1.0–2.0% by weight manganese, 0.4–1.5% by weight iron, 0.01–0.5% by weight magnesium and the rest of aluminum and impurities, which is aimed at good elongation because elongation is one of the most important factor the steering wheel should have to protect the driver at the collision by absorbing the impact. If manganese content is less than 1.0% by weight, which gives insufficient strength, if more than 2.0% by weight, which reduces the elongation. Thus manganese content should be 1.0–2.0% by weight. The reason for the range of iron and magnesium is similar to the above.

In the above aluminum alloy, it is preferable to change manganese content to 1.2–1.6% by weight and iron content to 0.4–0.7% by weight, without changing magnesium content. Iron content more than 0,7% by weight can not further improve the elongation. On the contrary, iron less than 0.4% by weight gives insufficient fractures characteristics. Thus iron should be between 0.4 and 0.7% by weight The reason for the range of manganese is for having the suitable strength and elongation. The elongation of steering wheel skeleton in this embodiment is more improved than that of the casting in embodiment I, so it gives safer steering wheel which can absorb the impact more without breaks. This quality is more secured when the alloy containing 1.2–1.6% by weight and 0.4–0.7 by weight iron is used.

Embodiment III

Figure 9:
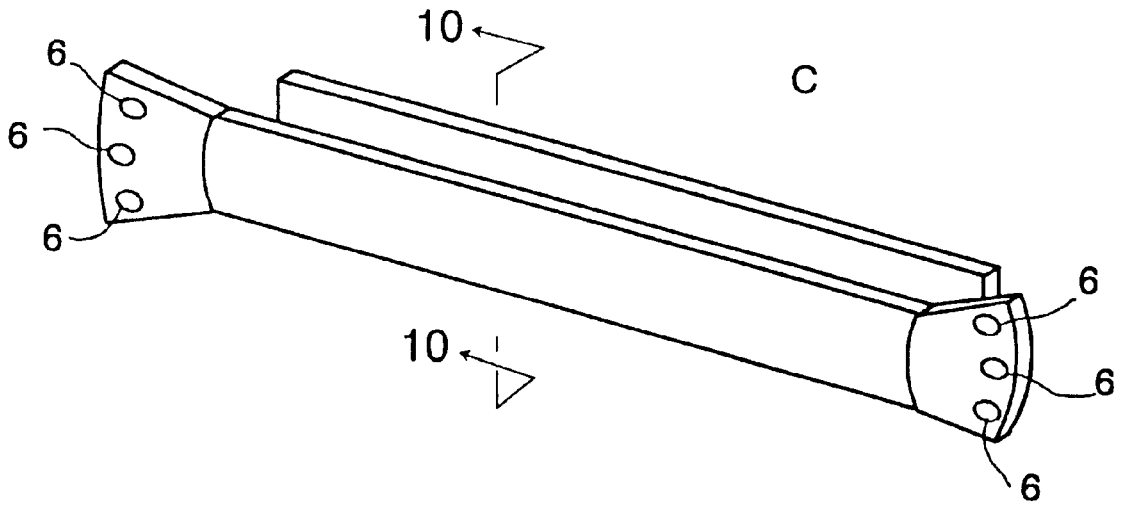
FIG. 9 is a perspective view of a door impact beam related another embodiment of the invention.
Figure 10:
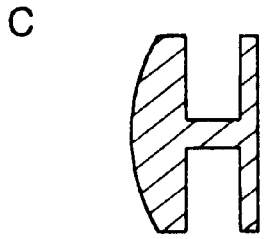
FIG. 10 is a cross-sectional view taken on line X—X in FIG. 9.

FIGS. 9 and 10 show a door impact beam C, which is fixed inside the door as reinforcements, to which the invention applied. The door impact beam has a slim shape both end of which have holes for bolt. Cross-section at the center area of the beam is H-shaped. The door beam is made from high ductility aluminum alloy, which contains 1.5–2.5% by weight manganese, 0.1–0.3% by weight iron and 0.7–1.2% by weight, which is aimed at the strength. Namely manganese content less than 1.5 reduces strength. The one more than 2.5% by weight lowers the elongation too much, so the manganese content should be between 1.5 and 2.5% by weight. The reason for the range of iron and magnesium is similar to the above.

In the above aluminum alloy, it is preferable to change manganese content to 1.8–2.2% by weight without changing iron and magnesium contents. The reason for this change is for securing more sufficient strength. The door impact beam is made directly by high pressure diecasting like in the embodiment II because it does not have a portion which make it impossible to separate the molds after finishing diecasting. By using the aluminum alloy aforementioned, the door impact beam C has higher strength than that of the panel in embodiment I.

Embodiment IV

Figure 11:
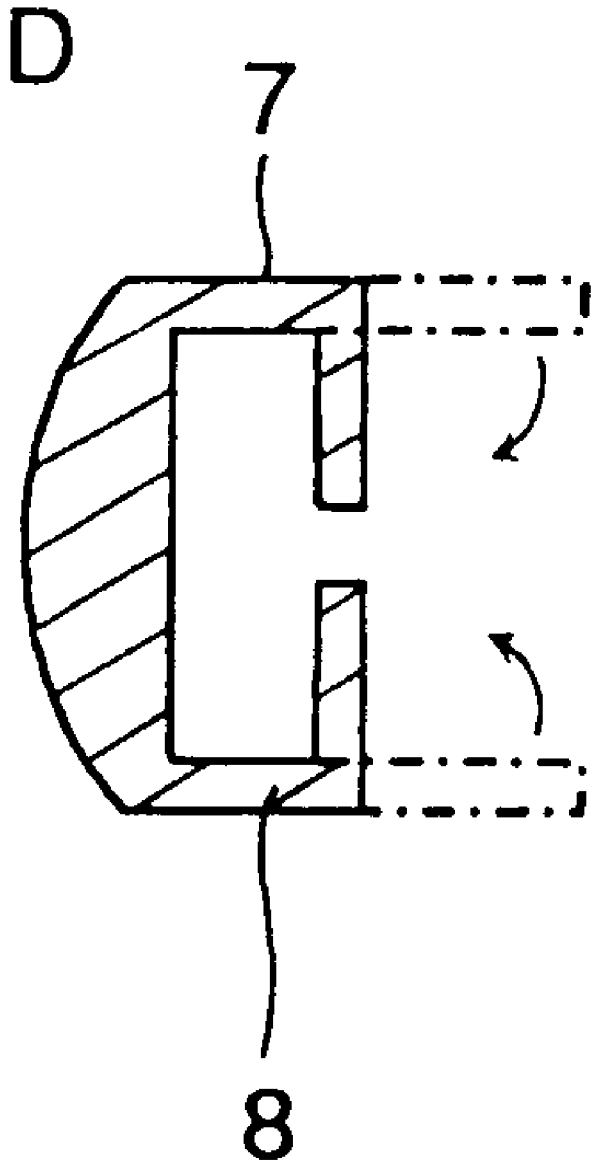
FIG. 11 is a corresponding one related to an embodiment of the invention to FIG. 10.

FIG. 11 bows a door impact beam D of which cross-section at the center area of the beam is roughly rectangular or modified C-shaped.

For manufacturing the door beam D, first a beam with modified cross-sectional shape, roughly U-shaped, shown with dotted line in the drawing that an upper portion 7 and a lower portion 8 are straightened is molded by high pressure diecasting from a high ductility aluminum alloy which is the same as the one used in embodiment 3. This shape makes it possible to separate the molds after finishing diecasting. And then the upper and the lower straightened portions are bent inward to make an originally designed shape approximately at room temperature. No fractures, cracks and breaks occur. The door beam D in this embodiment has higher structural rigidity than that of the beam C in embodiment 3.

Embodiment V

Figure 12:
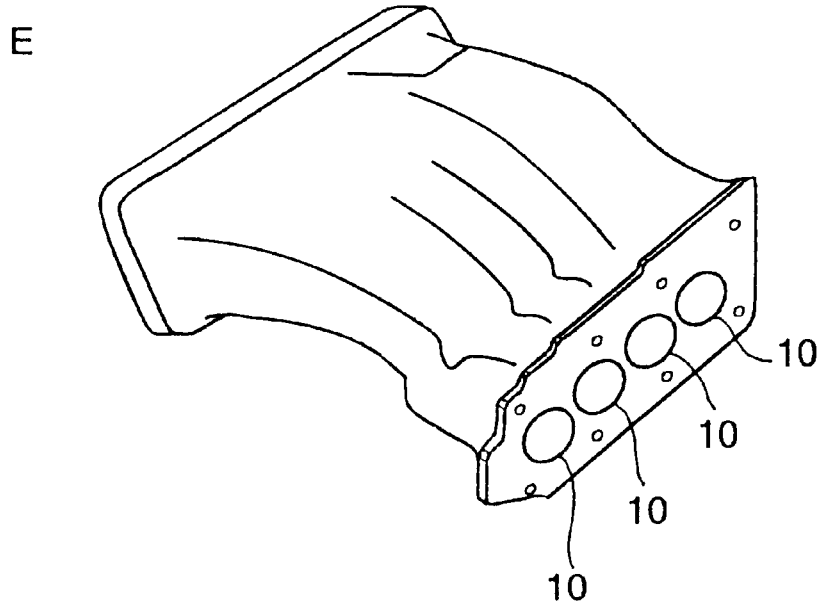
FIG. 12 is a perspective view of a surge tank related to another embodiment of the invention.

FIG. 12 shows a surge tank E installed in an intake system, to which the invention is applied. The surge tank E has curved intake passages 10 which gives outer wall of the surge tank similar curved shape. This surge tank E is integrally made by high pressure diecasting from a high ductility aluminum alloy which is the same as the one used in embodiment 1.

As the curved structure also makes it impossible to manufacture the surge tank directly by diecasting, it has to be straightened first for being diecasted and then curved bay bending to obtain the complete surge tank.

Previously a surge tank integrally made by casting had a rough sic on the inner wall of the intake passage because of using sand core to form the passage in the casting process. On the contrary the surge tank obtained through the invention has a very smooth surface of the intake passage because it is made by diecasting, therefor intake drag is reduced.

Embodiment VI

Figure 13:
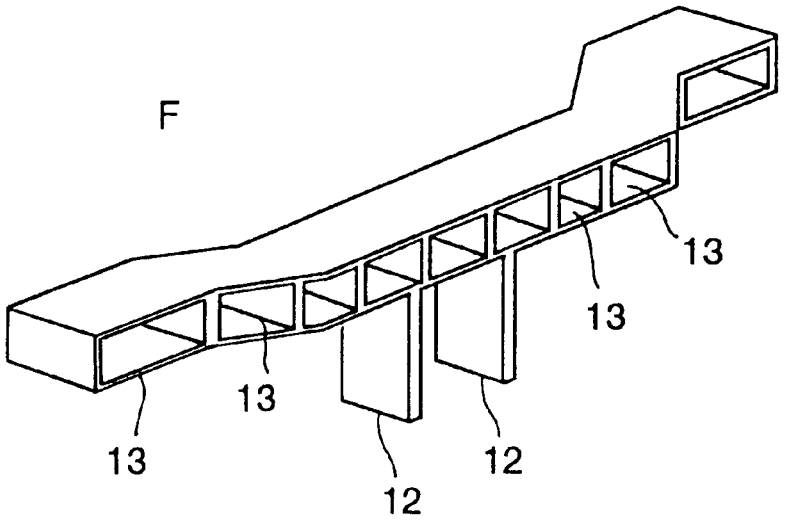
FIG. 13 is a perspective view of an instrument panel member related to another embodiment of the invention.
Figure 14:
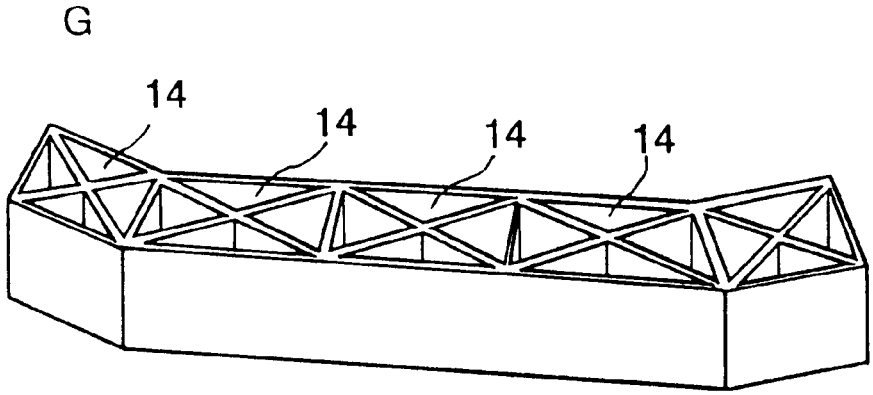
FIG. 14 is a perspective view of an bumper reinforcement related to another embodiment of the invention.

FIG. 13 shows an instrument panel member F secured to a plastic resin instrument panel for automobile as reinforcements, to which the invention is applied. The aluminum alloy instrument panel member has a slim body which has rectangular openings 13 to reduce the weight, in the middle area of the body are portions 12 for mounting a console box.

Embodiment VII

FIG. 1 shows a automobile bumper reinforcements G, to which the invention is applied. The aluminum alloy bumper reinforcements has rectangular openings with diagonally crossing stiffening ribs 14 therein.

Embodiment VIII

Figure 15:
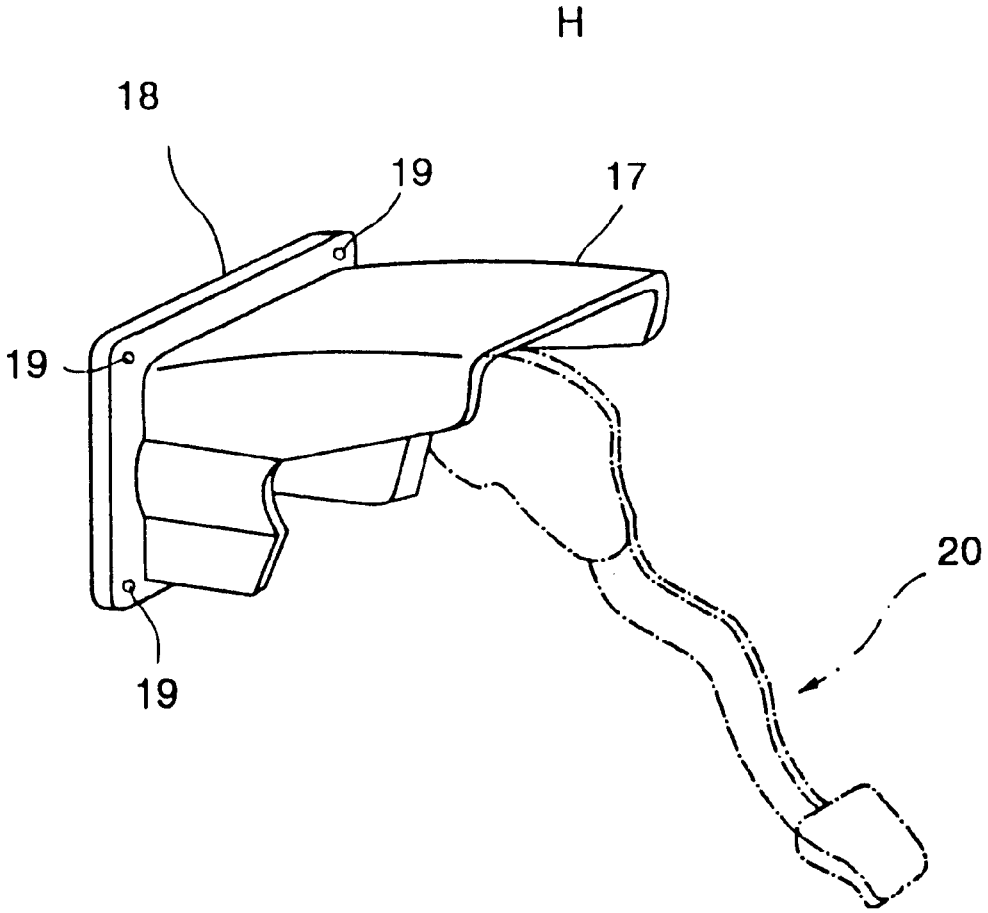
FIG. 15 is a perspective view of a pedal bracket related to another embodiment of the invention.

FIG. 15 shows an Al alloy pedal bracket H for supporting an accelerator pedal or a brake pedal, to which the invention is applied. The bracket H consist of a bracket body 17 and a flange 18 with a hole 19 for a bolt in each corner, those are molded in one piece.

Embodiment IX

Figure 16:
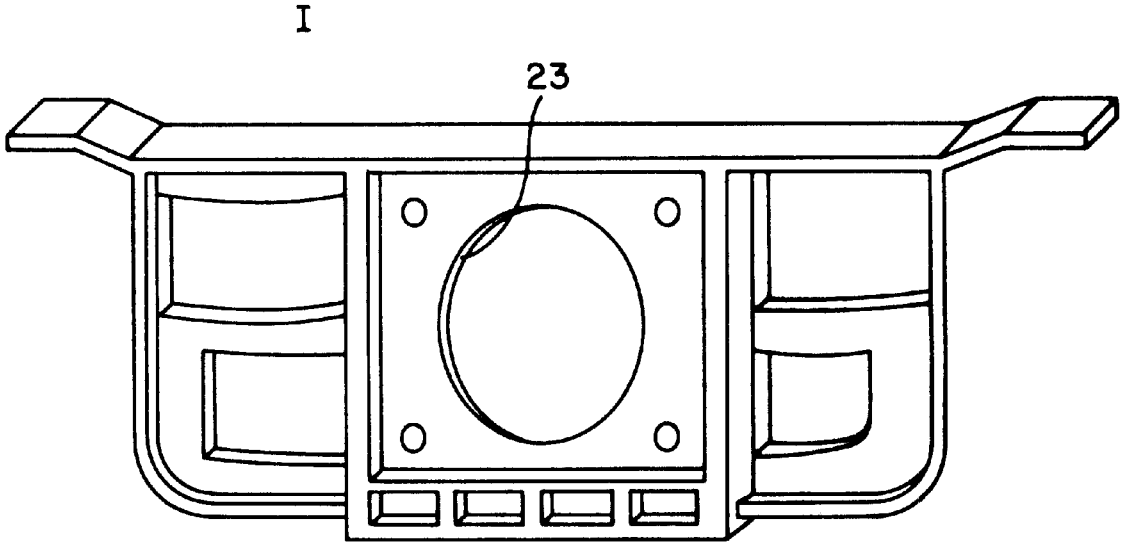
FIG. 16 is a perspective view of a front panel related to another embodiment of the invention.

FIG. 16 shows an aluminum alloy front panel 1 to be installed in the front of automobile, to which the invention is applied. The panel 1 with an opening space for a cooling fan in the middle area is molded integrally.

All of those parts aforementioned in embodiments 6 to 9 are made by high pressure diecasting from the high ductility aluminum alloy similar to the ones used in embodiments 1 to 5, which serve to reduce the cost and the weight of production and to increase the safety of passengers.

All of those embodiments use the aluminum alloys which contain manganese ingredient, iron ingredient and magnesium ingredient. They can also use the aluminum alloy which further contains at least one of following three ingredients; 0.1–0.2% by weight titanium, 0.01–0.1% by weight boron and 0.01–0.2% by weight beryllium.

Those titanium, boron and beryllium are capable of making the grains in a casting finer, which leads to the improvement of the fracture characteristics. But if the amount of additions are less than 0.1 & % by weight with titanium, less than 0.01 by weight with boron and less than 0.01% by weight with beryllium, the effect by the additions is not enough to improve the fracture characteristics. When the amount is more than 0.2%, 0.1% by weight respectively, large-size compounds are formed, which leads to lowering the elongation. Further titanium of this amount reduces the fluidity of the molten alloy. Thus those respective amounts previously set forth above should be chosen for improving the fracture characteristics without reducing the elongation of the alloys, which lead to increase the elongation of the castings. The invention of course can be applied to other automobile parts such as engine bracket, sheet frame, intake manifold and the like, and other parts than those of automobile.

EXAMPLES

Fourteen kinds of aluminum alloy made as examples of the invention, each of which is different from each other in its ingredients and contents thereof are shown in Table 1, wherein every examples of course includes a trace of impurity.

Elongation, tensile strength and 0.2% durability of those 14 alloys as examples are measured in comparison with ADC6 of JIS and ADC7 of former JIS, wherein ADC6 contains 0.5% by weight manganese, 0.10% by weight iron, 4.00% by weight magnesium and 0.10% by weight silica and ADC7 contains 0.56 & by weight iron and 4.9% by weight silica, neither manganese nor magnesium.

Figure 17:
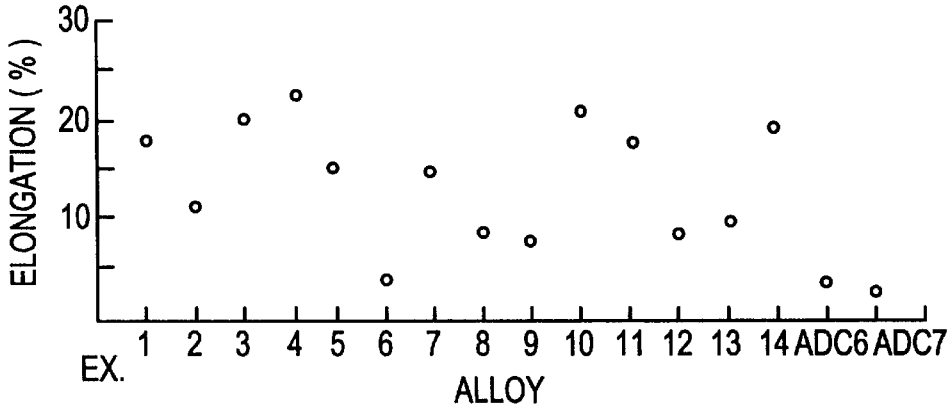
FIG. 17 is a graph showing a relation between elongation and types of alloy.
Figure 18:
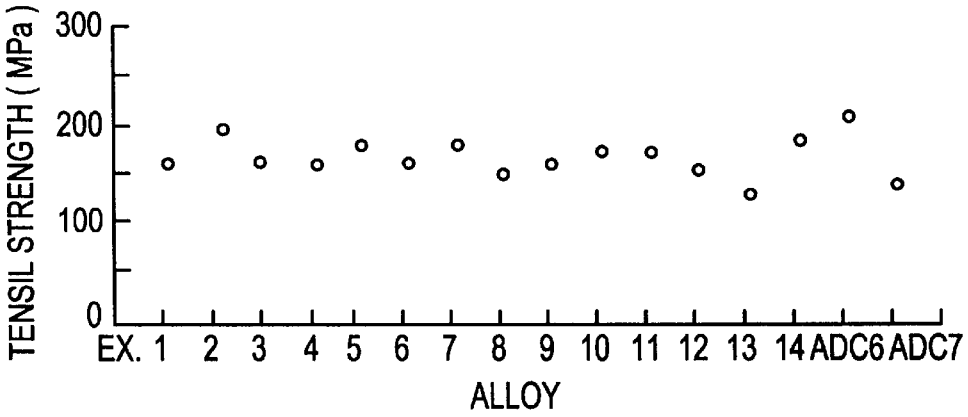
FIG. 18 is a graph showing a relation between tensile strength and types of alloy.
Figure 19:
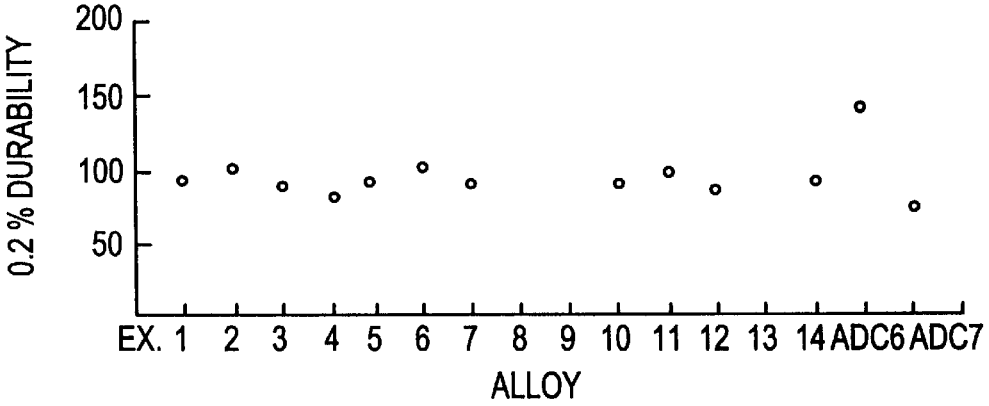
FIG. 19 is a graph showing a relation between 0.2% durability and types of alloy.

Measured mechanical properties of the casting made by high pressure diecasting from those aluminum alloys selected as examples are shown in table 1 and FIG. 17 to 19, and the internal structures, observed by optical microscope of 5×magnification, of the test pieces of examples 1, 2, ADC6 and ADC7 are shown respectively in FIGS. 22 to 25. It is found that each alloy of the invention in table 1 has better elongation than that of ADC6 or ADC7, by more than 10% in most case. It is also shown that tensile strength and 0.2% durability of every alloys in the table 1 have sufficient values.

Figure 21:
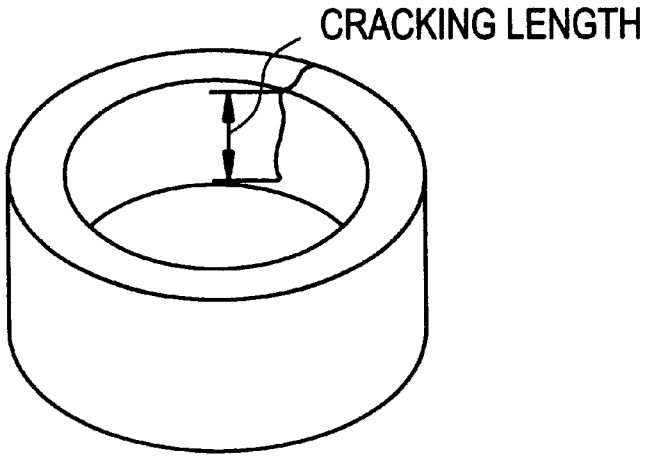
FIG. 21 is a perspective view of an test piece cast.
Figure 22:
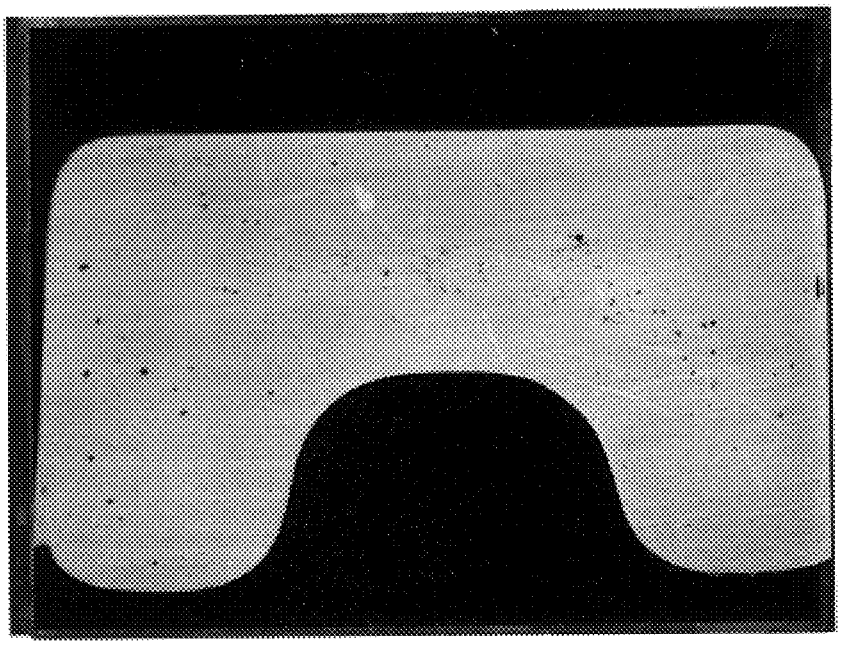
FIG. 22 is an optical microscopic photograph showing an internal structure of the test piece made from an alloy of example I.
Figure 23:
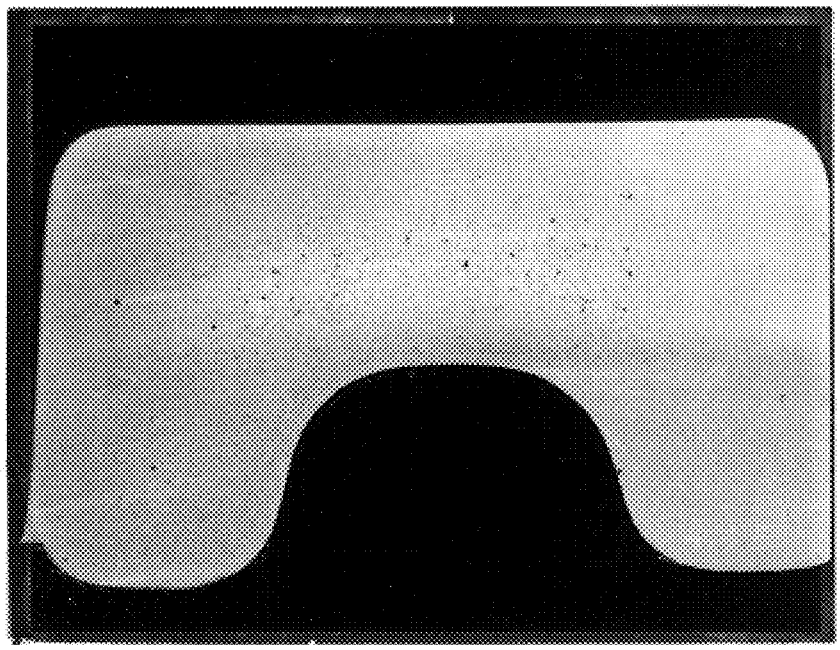
FIG. 23 is an optical microscopic photograph showing an internal structure of the test piece made from an alloy of example II.
Figure 24:
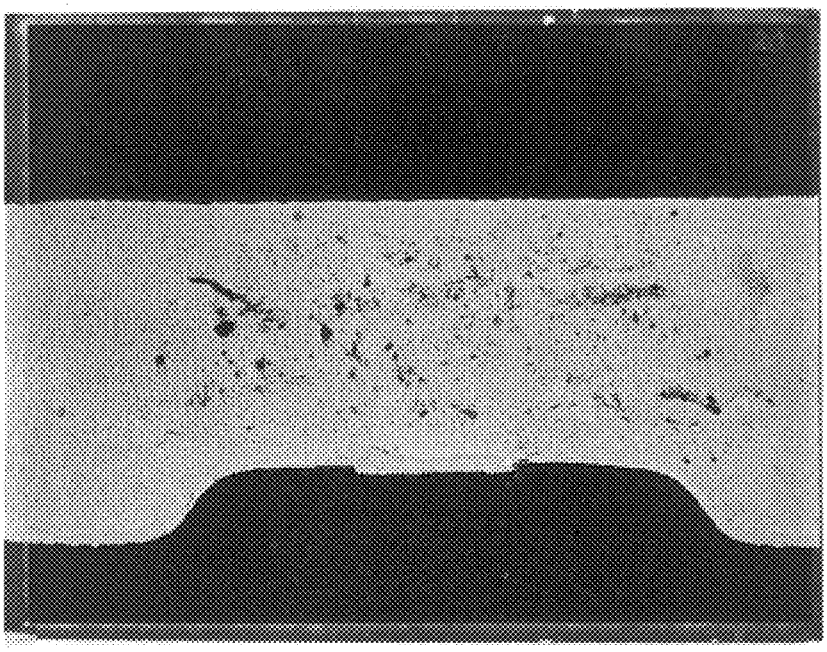
FIG. 24 is an optical microscopic photograph showing an internal structure of the test piece made from ABC6.
Figure 25:
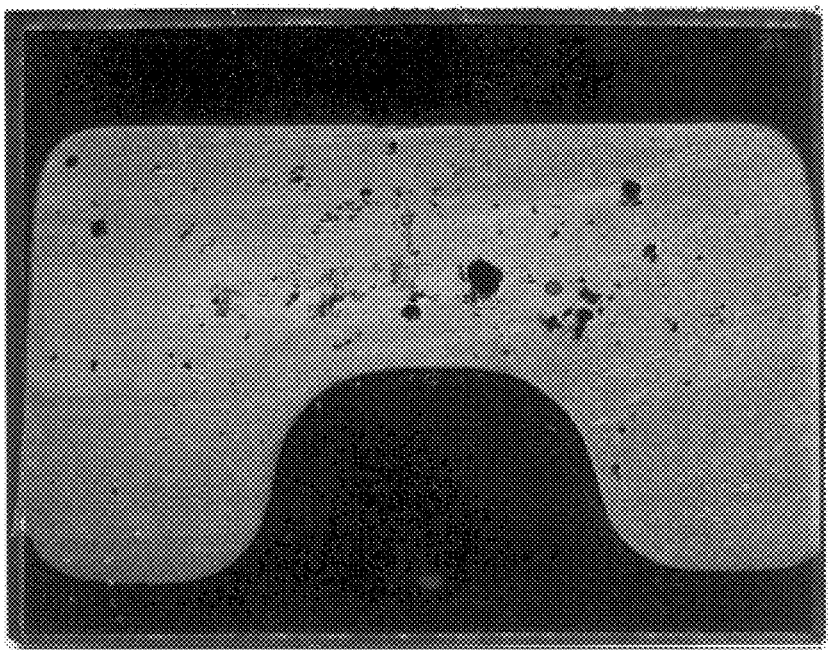
FIG. 25 is an optical microscopic photograph showing an internal structure of the test piece made form ADC7.
Figure 26:
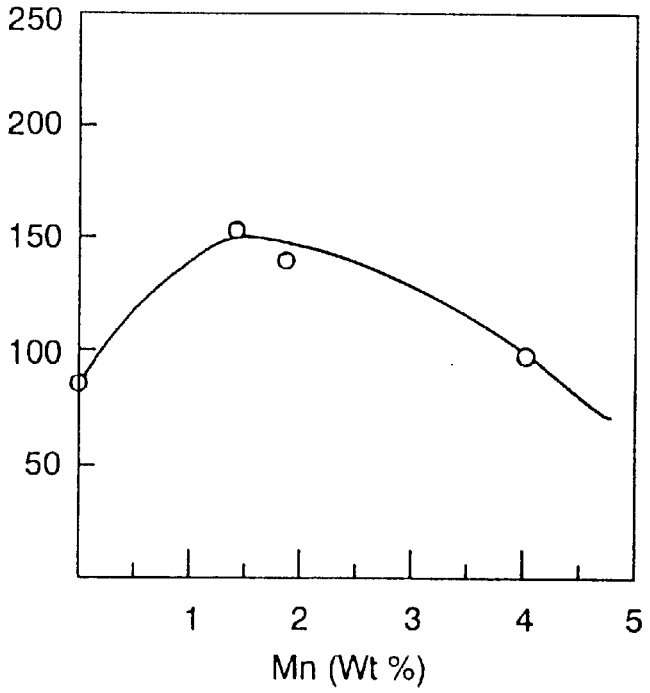
FIG. 26 is a graph showing a relation between manganese content and tensile strength.
Figure 27:
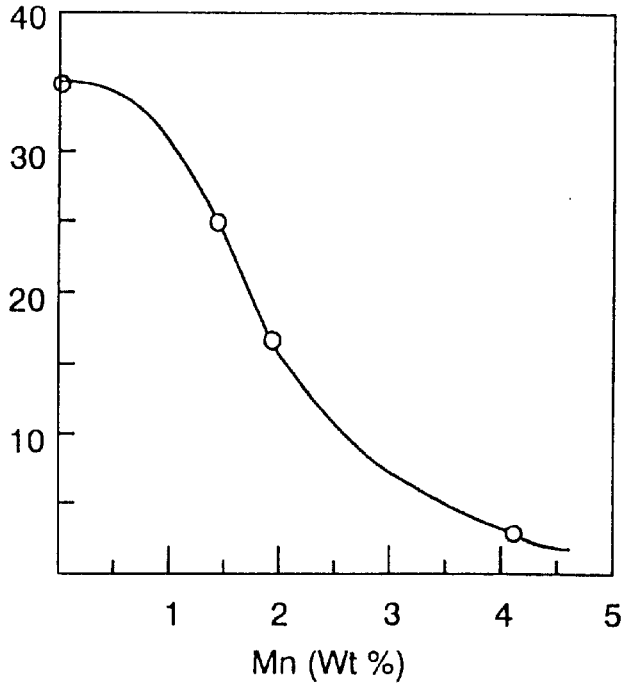
FIG. 27 is a graph showing a relation between manganese content and elongation.
Figure 28:
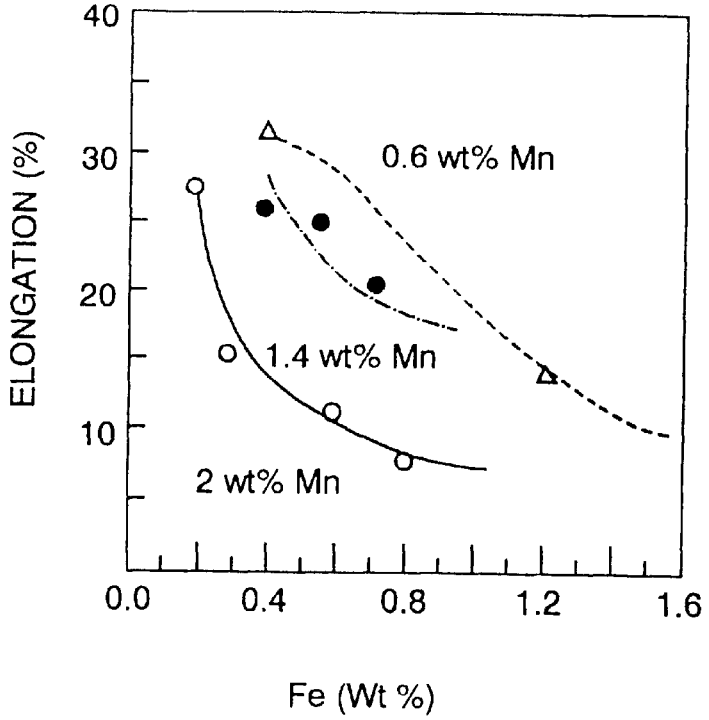
FIG. 28 is a graph showing a relation between iron content and elongation.
Figure 29:
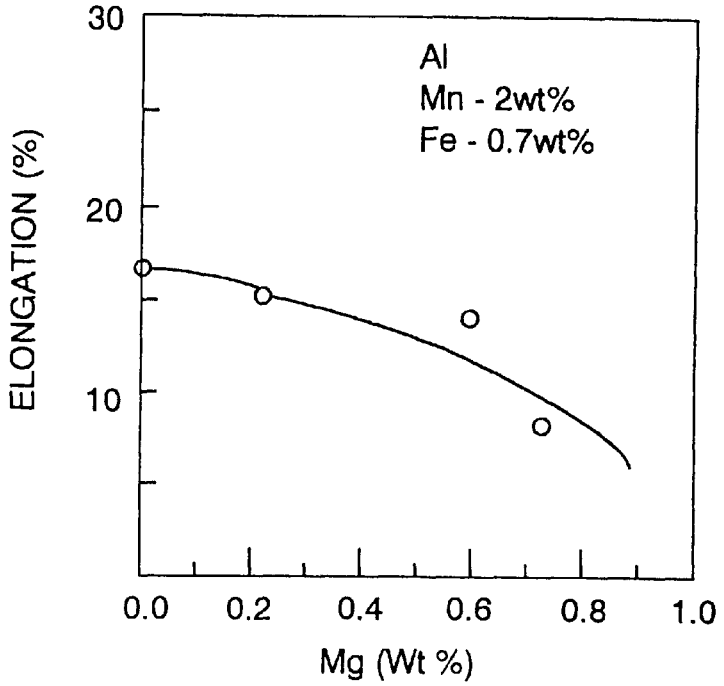
FIG. 29 is a graph showing relation between magnesium content and elongation.
Figure 30:
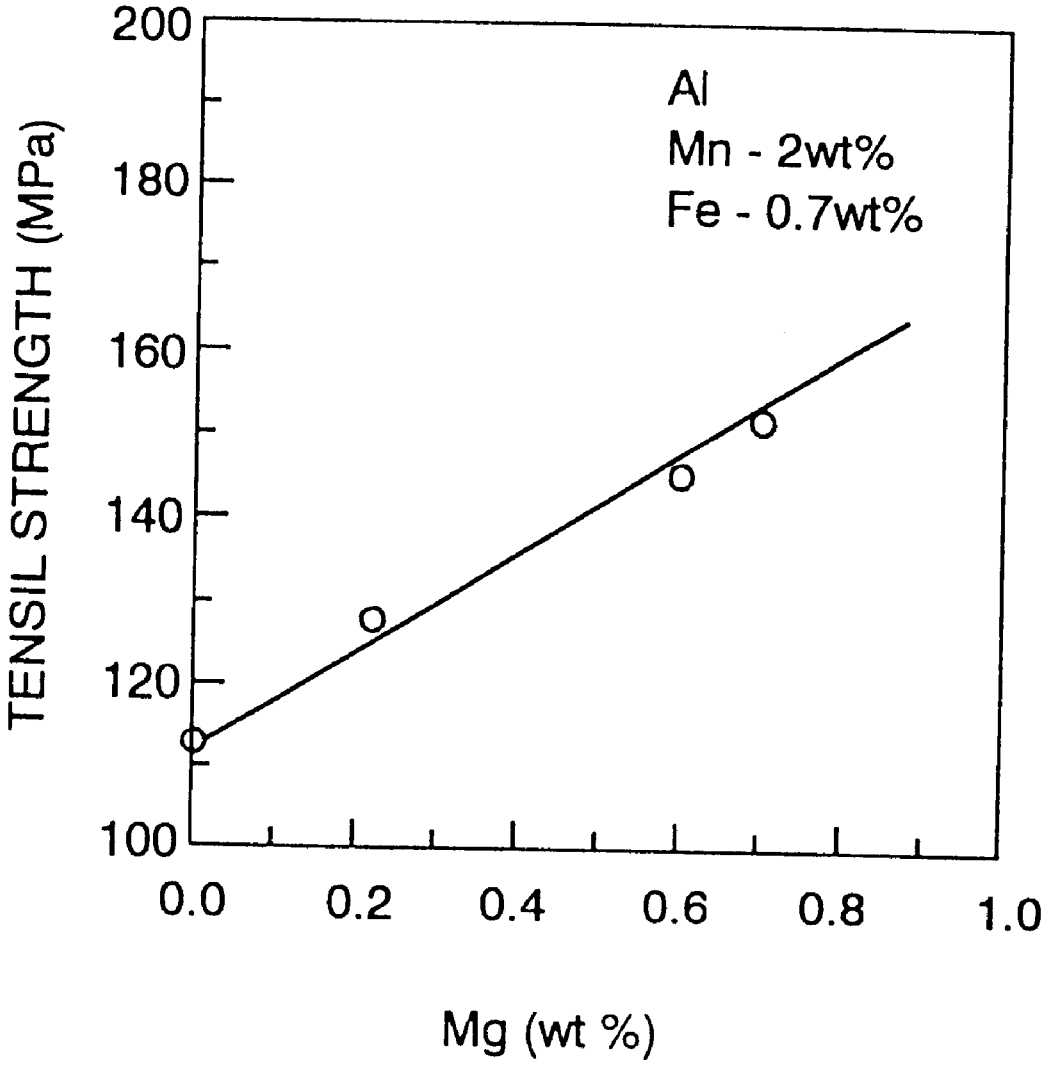
FIG. 30 is a graph showing relation between magnesium content and tensile strength.

FIG. 21 shows a ring of test piece which is made from the alloy of example 1, 2, ADC6 or ADC7 for evaluating the fracture characteristics. The molds for making the test pieces were placed at room temperature when they were made.

Figure 20:
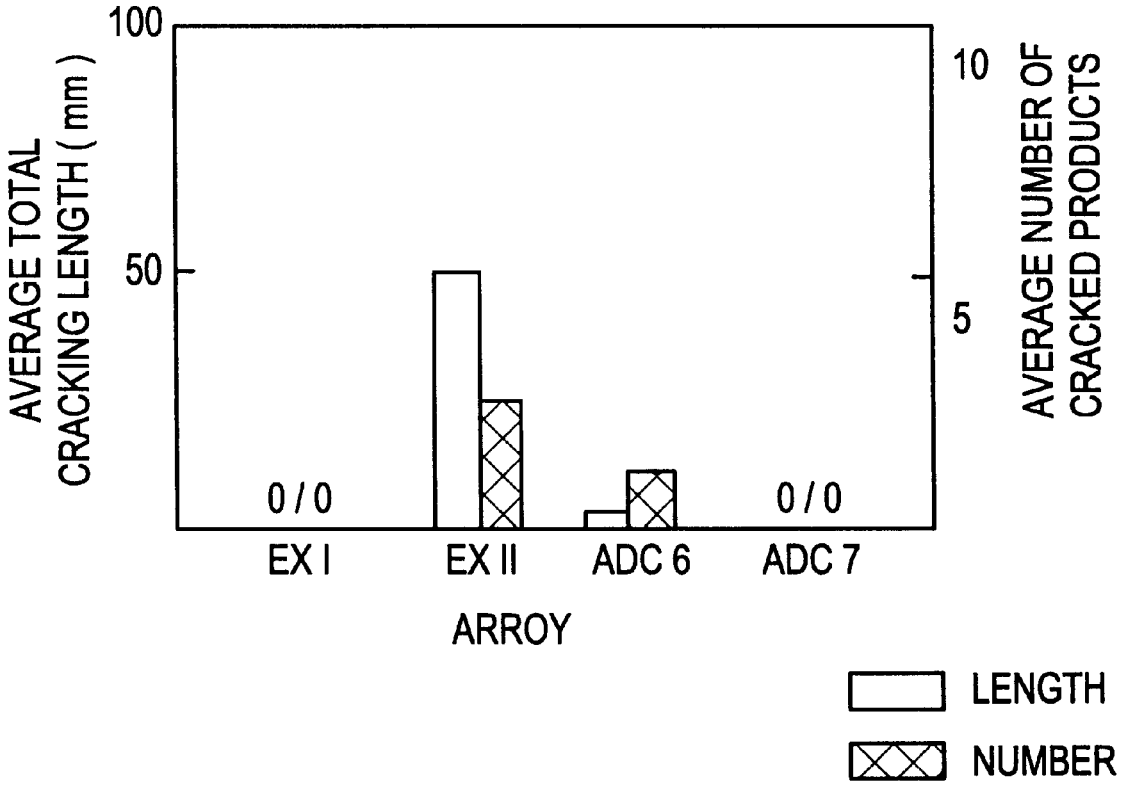
FIG. 20 is a graph showing a relation between an average total number of fractures or an average total length of the fractures and type of alloy.

FIG. 20 shows the result of the test where the average (total) length and the average (total) numbers of fractures are determined by measuring the number of fractures and the length of each fractures observed on the surface of test rings.

The alloy of example 1 provides a noticeable improvement in the fracture characteristics, which must have been caused by the composition of less magnesium content and fair amount of Fe content. As shown in FIGS. 22 to 25, the internal structure is better than that of ADC6 or ADC7 and almost no shrinkage cavity is observed.

The alloy of example 2 provides the worse fracture characteristics than that of other examples, but the casting characteristics is found to be improved from its internal structure. With respect to the alloys of other examples same evaluation tests were made and the results are shown in Table 1. In Table 1 casting characteristics and the more Fe content the better casting characteristics.

As a whole result it is found that the alloys of examples the better elongation and casting characteristics together with sufficient strength, especially the alloys of example 1 and 11 are superior in elongation and casting characteristics, and the alloys of examples 2 and 14 obtain increased strength, which causes slightly lower casting characteristics but it is still higher than that of conventional ones.

EFFECTS OF THE INVENTION

As can be seen in the above mentioned, the inventions in claims 1 to 8 give high ductility aluminum alloys which contains 1.0–2.0% by weight manganese, 0.4–1.5% by weight iron and 0.01–0.5% by weight magnesium. This composition gives improvements of elongation and casting characteristics without lowering strength. The invention in claims 2 or 9 gives high ductility aluminum alloys which contains 1.2–1.6 & % by weight manganese, 0.4–0.7% by weight iron and 0.01–0.5% by weight magnesium. This composition gives further improvement of elongation without

What is claimed is:

1. A method of producing a high ductile aluminum alloy product, which comprises the steps of:

squeeze die-casting a product from a high ductile aluminum allow comprising by weight 1.8 to 2.5% of manganese (Mn), 0.1 to 1.5% of iron (Fe), 0.01 to 1.2% of magnesium (Mg), and a balance of aluminum containing unavoidable impurities; and applying a local cold plastic working to said die-casting left casted.

2. A method of producing a high ductility aluminum alloy product as defined in claim 1, wherein said high ductility aluminum alloy further comprising by weight at least one of 0.1 to 0.2% of titanium (Ti), 0.01 to 0.1% boron (B), and 0.01 to 0.2% beryllium (Be).

3. A method of producing a high ductility aluminum alloy product as defined in claim 1, wherein said iron (Fe) content by weight is 0.4 to 1.5%, and said magnesium (Mg) content by weight is 0.01 to 0.5%.

4. A method of producing a high ductility aluminum alloy product as defined in claim 3, wherein said high ductility aluminum alloy further comprising by weight at least one of 0.1 to 0.2 % of titanium (Ti), 0.01 to 0.1 % boron (B), and 0.01 to 0.2% beryllium (Be).

5. A method of producing a high ductility aluminum alloy product as defined in claim 1, wherein said iron (Fe) content by weight is 0.1 to 0.3 %, and said magnesium (Mg) content by weight is 0.7 to 1.2 %.

6. A method of producing a high ductility aluminum alloy product as defined in claim 5, wherein said high ductility aluminum alloy further comprising by weight at least one of 0.1 to 0.2 % of titanium (Ti), 0.01 to 0.1% boron (B), and 0.01 to 0.2% beryllium (Be).

7. A method of producing a high ductility aluminum alloy product as defined in claim 5, wherein said manganese (Mn) content by weight is 1.8 to 2.2%.

8. A method of producing a high ductility aluminum alloy product as defined in claim 7, wherein said high ductility aluminum alloy further comprising by weight at least one of 0.1 to 0.2% of titanium (Ti), 0.01 to 0.1% boron (B), and 0.01 to 0.2% beryllium (Be).

9. A method of producing a high ductility aluminum alloy product as defined in claim 1, wherein said local cold plastic working is performed to bend part of said die-casting product to an internal radius larger than a thickness of said part.

10. A method of producing a high ductility aluminum alloy product as defined in claim 1, wherein said local cold plastic working is performed to drawing part of said die-casting product by press forming in which a die shoulder radius is greater in thickness more than five times than said part.

11. A method of producing a high ductility aluminum alloy product as defined in claim 1, wherein said local cold plastic working is performed to stretch part of said die-casting product by punch stretch forming in which a punch shoulder radius is greater in thickness more than five times than said part.

12. A method of producing a high ductility aluminum alloy product as defined in claim 1, wherein said local cold plastic working is applied to part of said die-cast product which is hardly plastic formed by said squeeze die-casting.

13. A method of producing a high ductile aluminum alloy product, which comprises the steps of:

squeeze die-casting a product from a high ductile aluminum alloy comprising by weight 1.8 to 2.2% of manganese (Mn), 0.4 to 1.5% of iron (Fe), 0.01 to 0.5% magnesium (Mg), and a balance of aluminum containing unavoidable impurities; and applying a local cold plastic working to said die-casting product left casted.

14. A method of producing a high ductile aluminum alloy product as defined in claim 13, wherein said high ductile aluminum alloy further comprises at least one of 0.1 to 0.2 weight % of titanium (Ti), 0.01 to 0.1 weight % of boron (B), and 0.01 to 0.2 weight % of beryllium (Be).

15. A method of producing a high ductile aluminum alloy product, which comprises the steps of:

squeeze die-casting a product from a high ductile aluminum alloy comprising by weight 1.8 to 2.2% of manganese (Mn), 0.1 to 0.3% of iron (Fe), 0.7 to 1.2% of magnesium (Mg), and a balance of aluminum containing unavoidable impurities; and applying a local cold plastic working to said die-casting product left casted.

16. A method of producing a high ductile aluminum alloy product as defined in claim 15, wherein said high ductile aluminum alloy further comprises at least one of 0.1 to 0.2 weight % of titanium (Ti), 0.01 to 0.1 weight % of boron (B), and 0.01 to 0.2 weight % of beryllium (Be).

* * * * *